US007267722B2

(12) United States Patent
Naruse et al.

(10) Patent No.: US 7,267,722 B2
(45) **Date of Patent: *Sep. 11, 2007**

(54) COATING APPARATUS FOR A TRAVELING WEB

(75) Inventors: Yasuhito Naruse, Shizuoka (JP); Atsushi Kakumoto, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/985,591

(22) Filed: Nov. 5, 2001

(65) Prior Publication Data

US 2002/0026895 A1 Mar. 7, 2002

Related U.S. Application Data

(63) Continuation of application No. 09/525,686, filed on Mar. 15, 2000, now Pat. No. 6,364,952, which is a continuation of application No. 08/714,327, filed on Sep. 18, 1996, now Pat. No. 6,068,700.

(30) Foreign Application Priority Data

Sep. 19, 1995 (JP) ..... 7-239770

(51) Int. Cl.
*B05C 1/00* (2006.01)

(52) U.S. Cl. ..... 118/206; 118/411; 118/419

(58) Field of Classification Search ..... 118/410, 118/213, 411, 412, 419, DIG. 3, DIG. 4, 118/209, 255, 206, 123, 225–228, 216–224, 118/313–316; 427/356; 101/182, 247, 184
See application file for complete search history.

(56) References Cited

U.S. PATENT DOCUMENTS 2,253,060 A * 8/1941 Clearman ..... 118/419
2,711,132 A * 6/1955 Viscardi (Continued)

FOREIGN PATENT DOCUMENTS

EP 0 261 613 3/1988

(Continued)

OTHER PUBLICATIONS

Coating Equipment and Processes, Lockwood Publishing Co, Inc New York, N. Y., pp. 83-91 and 132-148, 1970.*
Patent Abstracts of Japan, vol. 012, No. 299 (C-520), Aug. 15, 1998.

*Primary Examiner*—Brenda A. Lamb
(74) *Attorney, Agent, or Firm*—Sughrue Mion, PLLC

(57) ABSTRACT

A coating apparatus for a traveling web comprising two coating heads and a traveling path changing roller is disclosed. A bar coater is arranged close to a pass roller. The bar coater is fixed at such a position as to contact the web when the pass roller is moved down. An extrusion coater is arranged below a backup roller in such a manner as to move up and down. If the pass roller moves up and bends up the traveling path of the web, the web separates from the bar coater. Then, if the extrusion coater moves up, the web is coated with the coating solution by the extrusion coater. If the pass roller and the extrusion coater move down, the web is coated with the coating solution by the bar coater.

7 Claims, 13 Drawing Sheets

U.S. PATENT DOCUMENTS

| | | | | | |
|---|---|---|---|---|---|
| 2,761,791 | A | | 9/1956 | Russell | |
| 2,975,754 | A | * | 3/1961 | Wright | |
| 3,556,832 | A | | 1/1971 | Park | |
| 3,606,861 | A | * | 9/1971 | Schaeuble | 118/224 |
| 3,676,184 | A | | 7/1972 | Spearin et al. | |
| 3,899,112 | A | | 8/1975 | Stark et al. | |
| 3,933,093 | A | * | 1/1976 | Vertegaal | |
| 4,020,194 | A | * | 4/1977 | McIntyre et al. | 427/172 |
| 4,048,950 | A | | 9/1977 | Rakowicz et al. | |
| 4,217,085 | A | | 8/1980 | Ljungberg et al. | |
| 4,250,207 | A | * | 2/1981 | Takahashi et al. | 427/211 |
| 4,256,037 | A | * | 3/1981 | Vertegaal | |
| 4,259,921 | A | | 4/1981 | Wallsten | |
| 4,277,301 | A | | 7/1981 | McIntyre et al. | |
| 4,325,784 | A | | 4/1982 | Dreher | |
| 4,354,449 | A | | 10/1982 | Zink | |
| 4,371,571 | A | | 2/1983 | McIntyre et al. | |
| 4,722,297 | A | | 2/1988 | Keable | |
| 4,746,545 | A | | 5/1988 | McIntyre | |
| 4,845,964 | A | | 7/1989 | Bors et al. | |
| 4,883,691 | A | | 11/1989 | McIntyre | |
| 4,921,729 | A | * | 5/1990 | Kaneko et al. | 427/131 |
| 5,032,428 | A | * | 7/1991 | Ogawa et al. | 427/130 |
| 5,202,164 | A | | 4/1993 | Takahashi et al. | |
| 5,203,920 | A | | 4/1993 | Plomer | |
| 5,306,523 | A | * | 4/1994 | Shibata | 427/129 |
| 5,339,658 | A | * | 8/1994 | Haselwander | 68/203 |
| 5,411,589 | A | | 5/1995 | Yoshida et al. | |
| 5,413,806 | A | | 5/1995 | Braun | |
| 5,458,913 | A | | 10/1995 | Tsunoda et al. | |
| 5,614,260 | A | * | 3/1997 | Darcy | |
| 5,965,220 | A | * | 10/1999 | Schopping | |

FOREIGN PATENT DOCUMENTS

| | | |
|---|---|---|
| FR | 1 313 630 | 4/1963 |
| FR | 2 272 753 | 12/1975 |
| GB | 1 419 647 | 12/1975 |
| GB | 2 053 740 | 2/1981 |
| JP | 63 69573 | 3/1988 |
| JP | 6-106121 | 4/1994 |

* cited by examiner

COATING APPARATUS FOR A TRAVELING WEB

CROSS REFERENCE TO RELATED APPLICATIONS

This is a Continuation of application Ser. No. 09/525,686 (the "Parent Application") filed Mar. 15, 2000, now U.S. Pat. No. 6,364,952 which is in turn a Continuation of application Ser. No. 08/714,327 (the "Grandparent Application") filed Sep. 18, 1996 and issued as U.S. Pat. No. 6,068,700 on May 30, 2000. The disclosures of the Parent and Grandparent Applications are incorporated herein by reference.

BACKGROUND OF THE INVENTION

1. Field of the Invention

The present invention relates to a coating apparatus for a traveling web, and more particularly to a coating apparatus which applies coating liquids to the traveling web such as polymer film, paper support, metal strip, etc.

2. Description of the Related Art

A roll coater, an extrusion coater, a slide bead coater, a gravure coater, a bar coater, etc. are known as a coater which coats a traveling web with a coating solution. These coaters are selected according to the coating solution and the product.

The Japanese Patent Application Laid-open No. 63-69573 discloses a coater in which two or more coating heads are arranged in series in the longitudinal direction of a traveling web, and the coating heads are used alternately. The U.S. Pat. No. 3,899,112 discloses a coater, which uses coating heads selectively on a web path composed of rollers.

However, in the case of the above-mentioned conventional coater, it is difficult to apply many types of the coating solution under a variety of conditions by one coater.

For example, the roll coater and the bar coater are suitable for applying the web with a thin layer; but when the web is already coated with something, a problem tends to occur that the coated layer is damaged.

In the case of the extrusion coater, the coated layer is hardly damaged. However, some coating solution causes a problem in that the web cannot be coated evenly or cannot be applied with a thin layer.

Furthermore, in a coater with only one coating head, there exists disadvantage that plenty of time is required before starting to coat new solution which differs from previous coating solution, because it is necessary to clean the coating head and to prepare the new coating solution.

Therefore, in order to eliminate the above-mentioned disadvantages, two coating heads 1 and 2 are provided on the traveling path of the web 3 as shown in FIG. 13. For example, in the case when the coating head 2 is expected to be used by the method of the coating head 1, a web 3 is cut between a pass roller 4 and a pass roller 5, and the leading end of the web 3 is conveyed by being supported on a backup roller 7 via a pass roller 6, so that the coating head 2 can coat the web as shown in FIG. 14 (the Japanese Patent Application Laid-open No. 63-69573). However, this coater has a disadvantage in that it requires a lot of time for preparation because the web 3 should be cut every time the coating head is replaced, and the traveling path of the web 3 needs to be changed.

Moreover, the coating head may be provided in such a manner as to be installed and removed freely, and the coating head is selectively replaced according to the condition. However, the replacement of the coating head requires a lot of time, and it is difficult to install the coating head accurately.

SUMMARY OF THE INVENTION

The present invention has been developed under the above-described circumstances, and has its object the provision of a coating apparatus for a traveling web, which is able to coat the web with a coating solution efficiently without replacing a coating head or cutting the web.

In order to achieve the above-mentioned object, a coating apparatus for a traveling web comprises: plural coating heads arranged in a traveling path of the web; and traveling path changing means arranged close to the plural coating heads; wherein the traveling path changing means changes the traveling path of the web, so that the web is made close to at least one of the plural coating heads, which is used selectively for coating.

According to the present invention, the traveling path changing means arranged close to the plural coating head is moved to change the traveling path of the web, so that the web can become close to at least one of the plural coating heads, which is used selectively for coating. In the invention, there is no need to replace the coating head every time the coating conditions are changed. Moreover, there is no need to cut the web to change the traveling path of the web. Therefore, the web can be efficiently coated with the coating solution.

Furthermore, plural coating heads are provided in such a manner as to move toward and away from the traveling path of the web, and at least one coating head selected for coating is moved toward the traveling path of the web so as to be arranged close to the web, and another coating head is moved away from the traveling path of the web. Therefore, in the invention, the coating by the selected coating head can be performed without fail, and the incorrect coating by another coating head can be prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
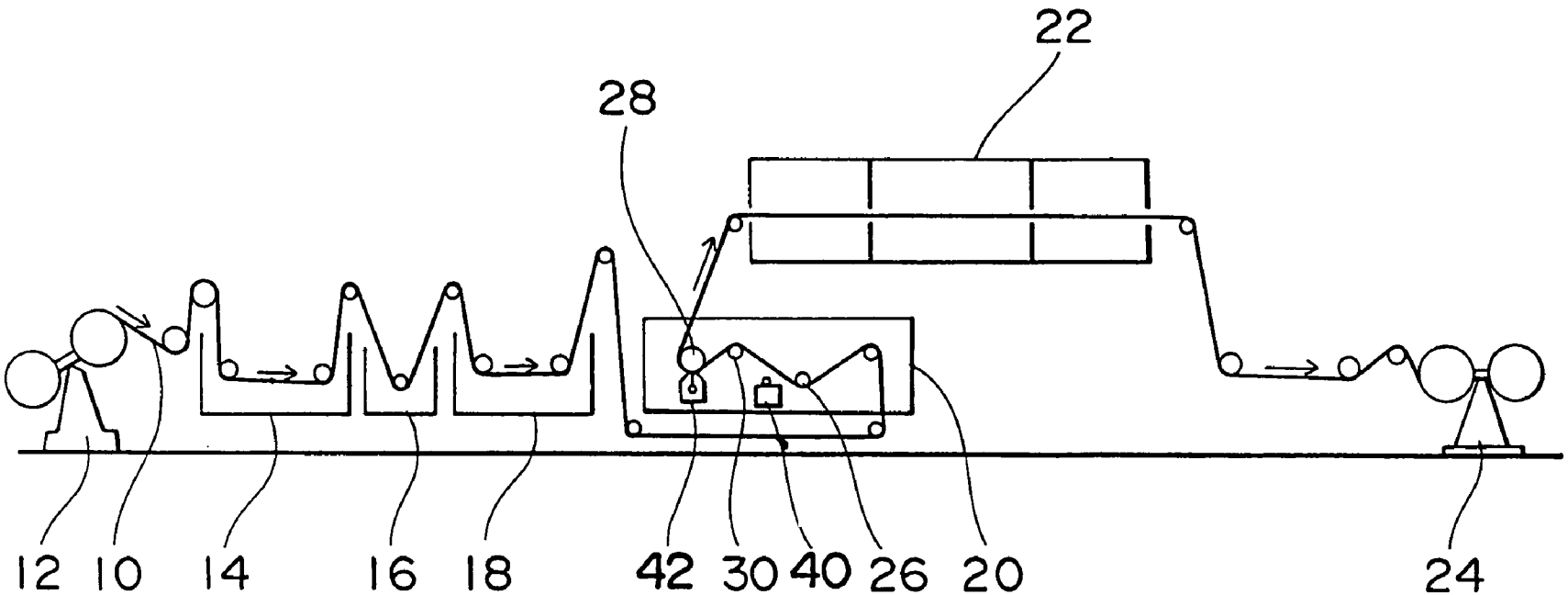
FIG. 1 is a side view showing the entire web surface processing apparatus adopting the first embodiment of the invention.

FIG. 1 is a side view illustrating an entire web surface processing apparatus adopting the first embodiment of the invention. As shown in the figure, the web 10 is unwound by a web unwinding device 12 and led to a coater 20 through surface processing vessels 14, 16 and 18. After the web 10 passes the coater 20, it is dried by a dryer 22 and wound up by a web windup device 24.

The web 10 is, for example, paper, plastic film, resin-coated paper, aluminum web, and synthetic paper. The plastic film is made of, for example, polyolefine such as polyethylene and polypropylene; vinyl-polymer such as polyvinyl acetate, polyvinyl chloride, and polystyrene; polyamide such as 6,6-nylon and 6-nylon; polyester such as polyethylene terephthalate and polyethylene-2,6-naphthalate; polycarbonate; and cellulose acetate such as cellulose triacetate and cellulose diacetate. The polyolefine such as polyethylene is ordinarily used for the resin-coated paper; however, other kinds of resin may be used.

Figure 2:
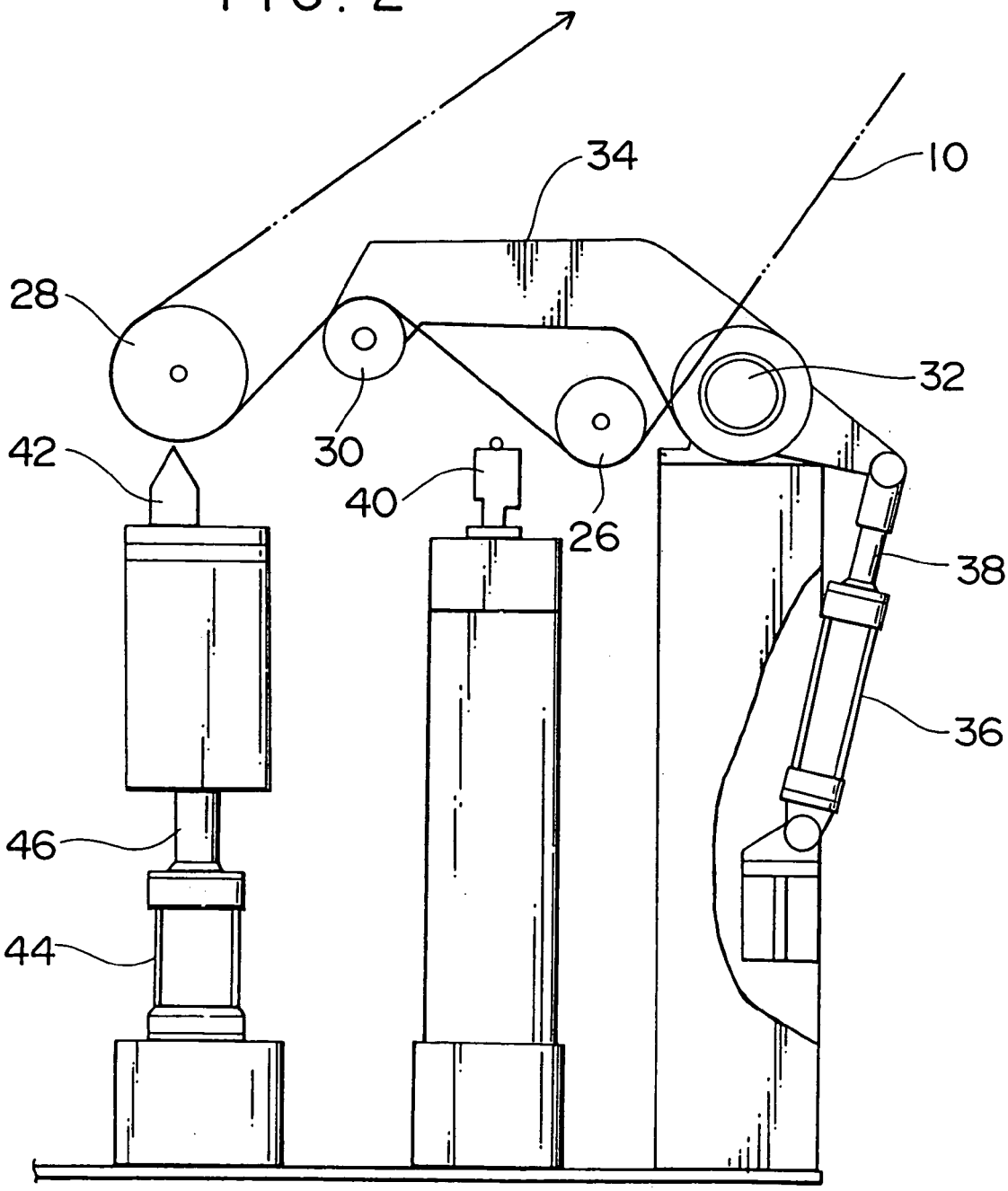
FIG. 2 is a side view showing the function of a coating apparatus according to the first embodiment of the invention.
Figure 3:
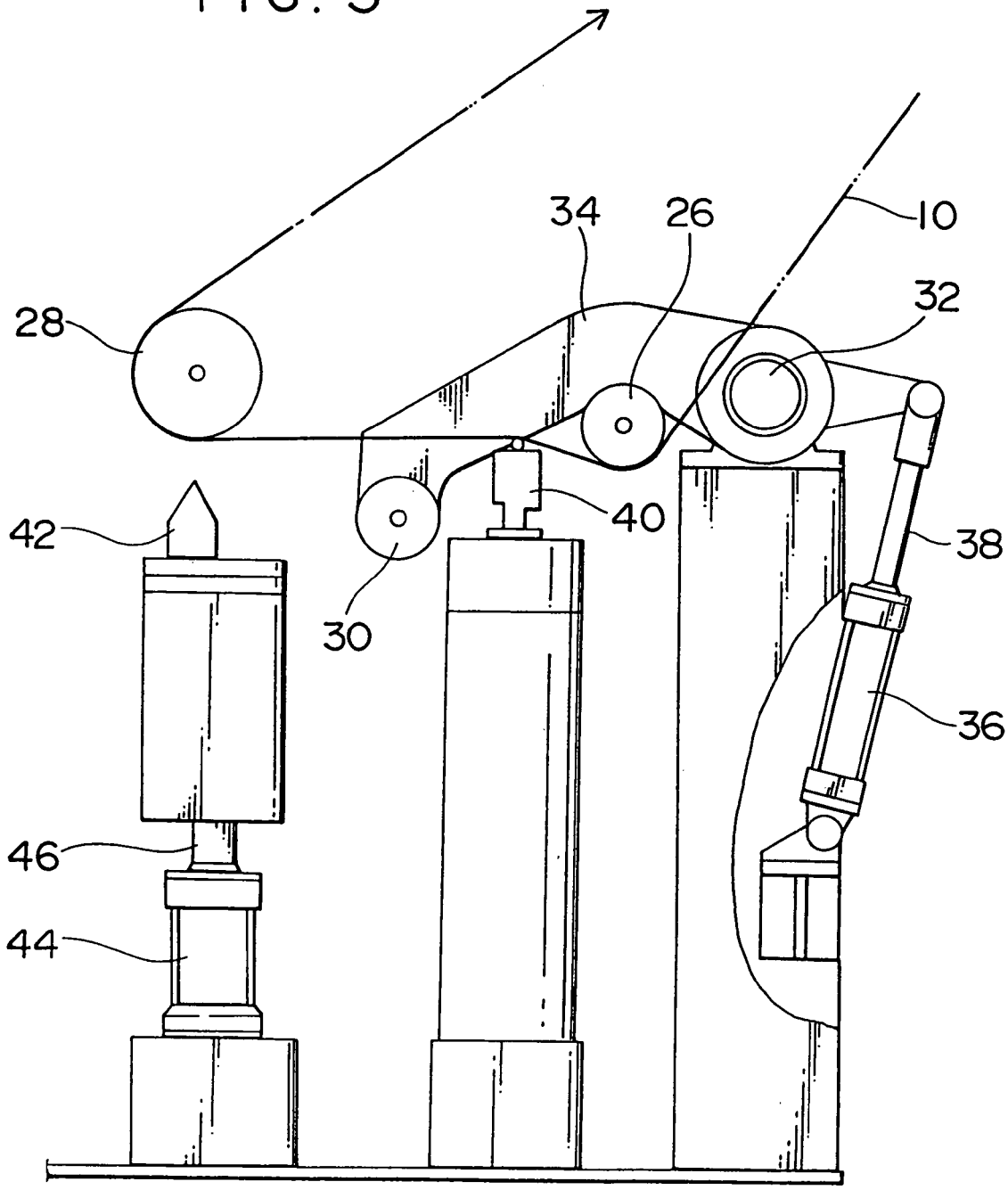
FIG. 3 is a side view showing the function of a coating apparatus according to the first embodiment of the invention.

As shown in FIG. 2, a traveling path changing roller 30 capable of moving up and down is provided between a pass roller 26 and a backup roller 28 at the inside of the coater 20. The pass roller 30 is rotatably attached to the left end of an arm 34 arranged in such a manner as to rotate around an axis 32. A rod 38 of a hydraulic cylinder 36 is attached to the right end of the arm 34. Therefore, if the rod 38 of the hydraulic cylinder 36 contracts, the arm 34 rotates clockwise around the axis 32. As a result, the pass roller 30 is moved to the upper position as shown in FIG. 2, and contacts the web 10 to bend up the traveling path of the web 10. If the rod 38 of the hydraulic cylinder 36 extends, the arm 34 rotates counterclockwise around the axis 32. As a result, the pass roller 30 moves to the lower position as shown in FIG. 3, and separates from the web 10 to make horizontal the traveling path of the web 10.

A bar coater (a coating head) 40 is arranged close to the downstream side of the pass roller 26 with regard to the traveling direction of the web 10. The bar coater 40 is fixed at such a position as to contact the surface of the web 10 stretched between the pass roller 26 and the backup roller 28 when the pass roller 30 is moved down as shown in FIG. 3. An extrusion coater (a coating head) 42 is arranged below the backup roller 28. The extrusion coater 42 is fixed on a rod 46 of a hydraulic cylinder 44. If the rod 46 extends, the extrusion coater 42 moves to the upper position as shown in FIG. 2 (a position close to the web 10 supported on the backup roller 28). If the rod 46 contracts, the extrusion coater 42 moves to the lower position as shown in FIG. 3.

Next, an explanation will be given about the operation of the first embodiment constructed in the above-mentioned manner.

When the extrusion coater 42 is selected, as shown in FIG. 2, the rod 38 of the hydraulic cylinder 36 contracts, and the arm 34 rotates clockwise, so that the pass roller 30 moves up. As a result, the pass roller 30 contacts the web 10, and the traveling path of the web 10 is bent up, so that the web 10 separates from the bar coater 40. Then, the extrusion coater 42 is moved up by the hydraulic cylinder 44 to be close to the web 10 supported on the backup roller 28. After that, the extrusion coater 42 is driven. As a result, the web 10 is coated with the coating solution by the extrusion-coater 42.

Next, if the bar coater 40 is selected, as shown in FIG. 3, the rod 38 of the hydraulic cylinder 36 extends, and the arm 34 rotates counterclockwise from the state in FIG. 2, so that the pass roller 30 moves down. As a result, the pass roller 30 separates from the traveling path of the web 10, and the web 10 contacts the bar coater 40. Then, the extrusion coater 42 is moved down by the hydraulic cylinder 44 in association with the above-mentioned movement. After that, the bar coater 40 is driven. As a result, the web 10 is coated with the coating solution by the bar coater 40.

Thus, the pass roller 30 is moved up and down, so that the traveling path of the web 10 can be changed, and one of the two coating heads 40 and 42 is selected. As a result, there is no need to replace the coater every time the coating conditions are changed. Moreover, there is no need to cut the web 10 to change the traveling path of the web 10. Therefore, the web 10 can be efficiently coated with the coating solution in the first embodiment.

Figure 4:
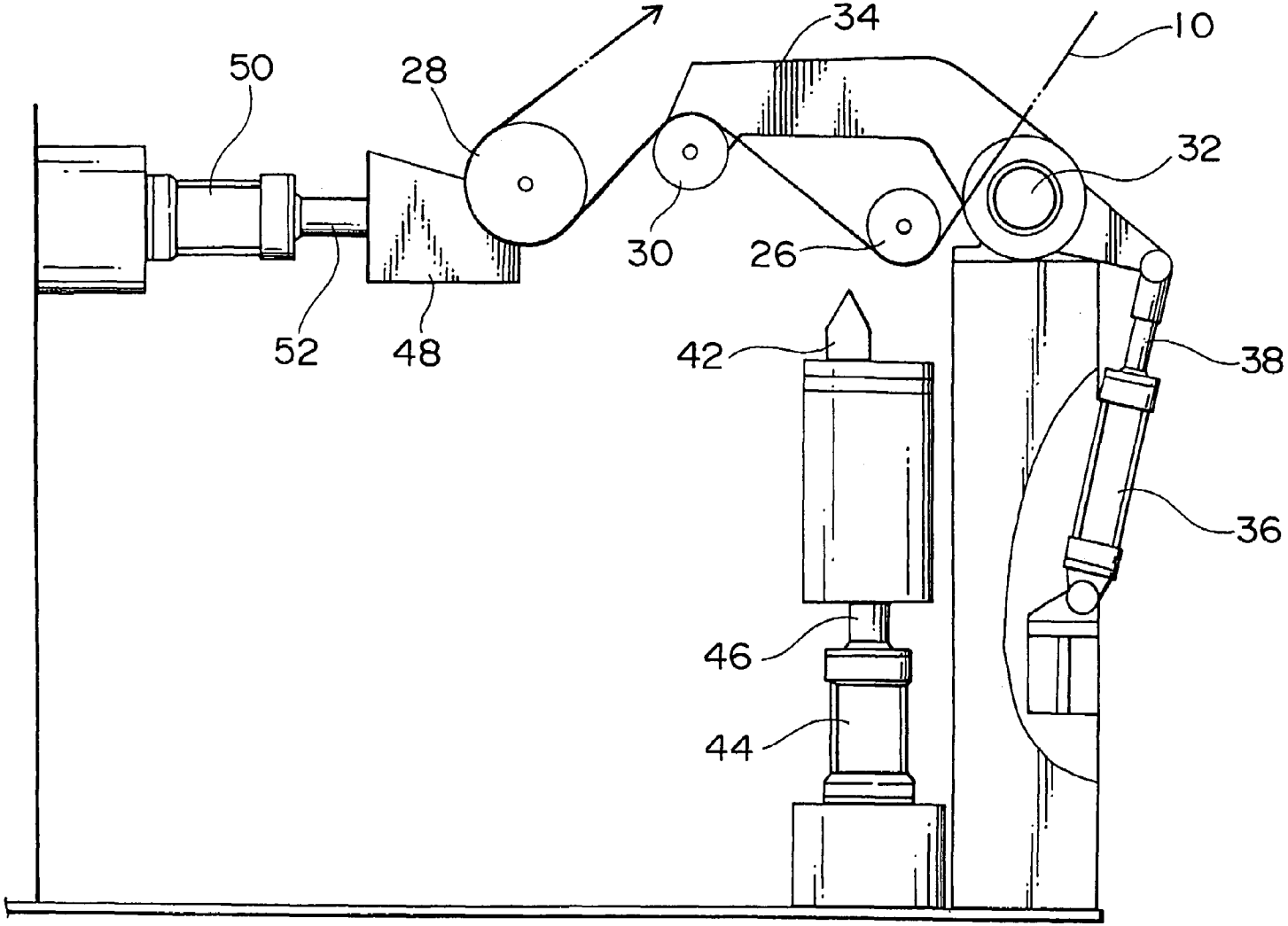
FIG. 4 is a side view showing the function of a coating apparatus according to the second embodiment of the invention.
Figure 5:
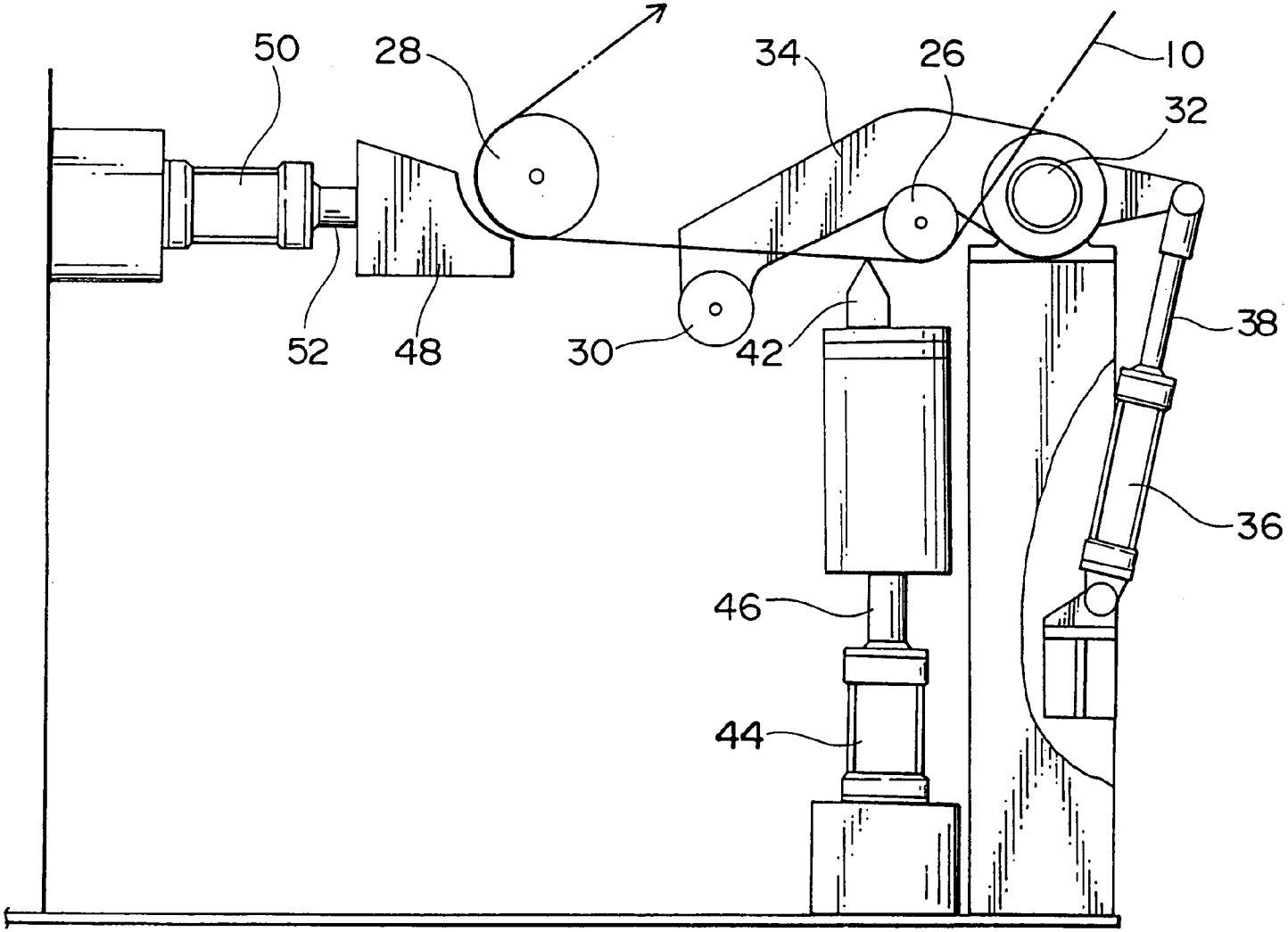
FIG. 5 is a side view showing the function of a coating apparatus according to the second embodiment of the invention.

FIGS. 4 and 5 show the structure of the coating apparatus according to the second embodiment of the invention. The same reference numbers are designated on the same or similar members as those of the first embodiment shown in FIGS. 2 and 3.

The coater in FIGS. 4 and 5 is constructed in such a manner that the extrusion coater (the coating head) 42 is arranged below the pass roller 26 in such a manner as to move up and down due to the extension and contraction of the rod 46 of the hydraulic cylinder 44, and a slide bead coater (a coating head) 48 is arranged at the left-hand side by the backup roller 28 in such a manner as to move to the right and left due to the extension and contraction of a rod 52 of a hydraulic cylinder 50.

When the slide bead coater 48 is selected, as shown in FIG. 4, the pass roller 30 moves up due to the contraction of the rod 38 of the hydraulic cylinder 36, and the traveling path of the web 10 is bent up. The extrusion coater 42 moves down due to the contraction of the rod 46 of the hydraulic cylinder 44. Then, the slide bead coater 48 moves toward the backup roller 28 due to the extension of the rod 52 of the hydraulic cylinder 50, so that it becomes close to the web 10 supported on the backup roller 28. After that, the slide bead coater 48 is driven. As a result, the web 10 is coated with the coating solution by the slide bead coater 48.

Next, if the extrusion coater 42 is selected, as shown in FIG. 5, the pass roller 30 moves down so as to separate from the traveling path of the web 10 due to the extension of the rod 38 of the hydraulic cylinder 36. The slide bead coater 48 separates away from the backup roller 28 due to the contraction of the rod 52 of the hydraulic cylinder 50. Then, the extrusion coater 42 moves up toward the traveling path of the web 10 due to the extension of the rod 46 of the hydraulic cylinder 44, so that it becomes close to the web 10. After that, the extrusion coater 42 is driven. As a result, the web 10 is coated with the coating solution by the extrusion coater 42.

Figure 6:
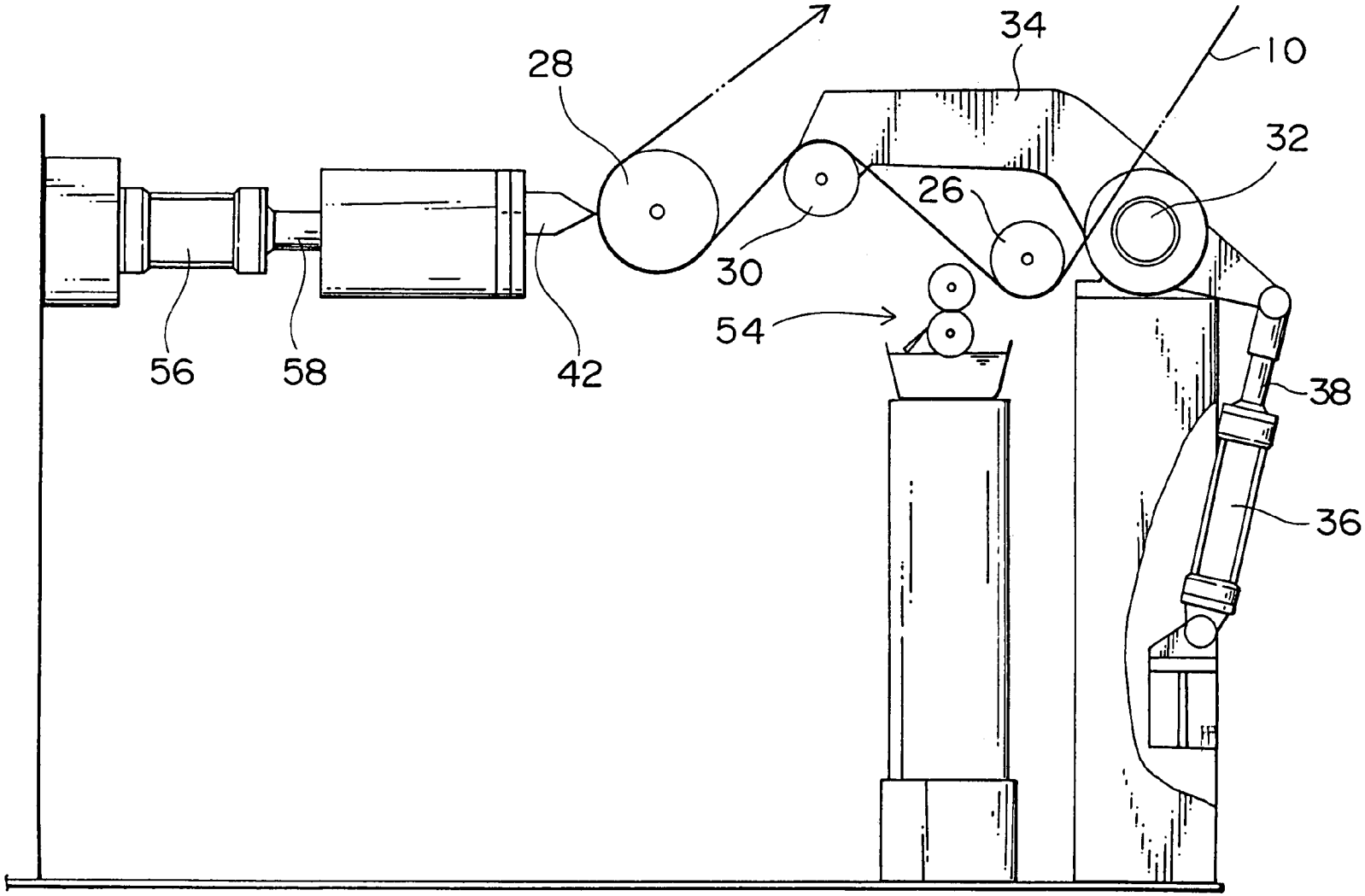
FIG. 6 is a side view showing the function of a coating apparatus according to the third embodiment of the invention.
Figure 7:
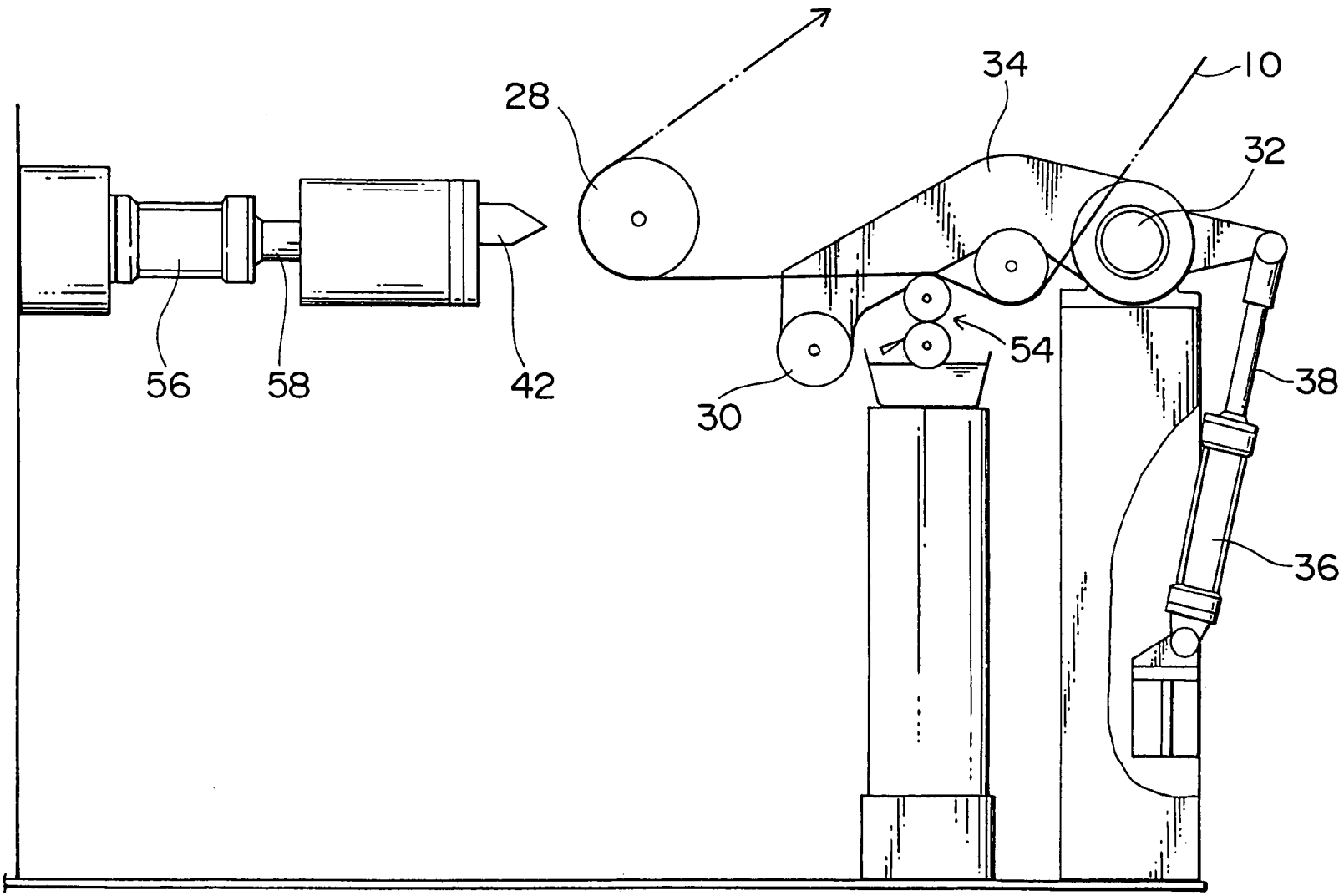
FIG. 7 is a side view showing the function of a coating apparatus according to the third embodiment of the invention.

FIGS. 6 and 7 show the structure of the coating apparatus according to the third embodiment of the invention. The same reference numbers are designated on the same or similar members as those of the first embodiment shown in FIGS. 2 and 3.

The coater in FIGS. 6 and 7 is constructed in such a manner that a roll coater (a coating head) 54 is fixed close to the downstream side of the pass roller 26 with regard to the traveling direction of the web 10, and the extrusion coater (the coating head) 42 is arranged at the left-hand side by the backup roller 28 in such a manner as to move to the right and left due to the extension and contraction of a rod 58 of a hydraulic cylinder 56.

When the extrusion coater 42 is selected, as shown in FIG. 6, the pass roller 30 moves up due to the contraction of the rod 38 of the hydraulic cylinder 36. The traveling path of the web 10 is bent up, and the web 10 separates from the roll coater 54. Then, the extrusion coater 42 moves toward the backup roller 28 due to the extension of the rod 58 of the hydraulic cylinder 56, so that it becomes close to the web 10 supported on the backup roller 28. After that, the extrusion coater 42 is driven. As a result, the web 10 is coated with the coating solution by the extrusion coater 42.

Next, if the roll coater 54 is selected, as shown in FIG. 7, the extrusion coater 42 separates from the backup roller 28 due to the contraction of the rod 58 of the hydraulic cylinder 56. The pass roller 30 moves down due to the extension of the rod 38 of the hydraulic cylinder 36, and the traveling path of the web 10 is changed, so that the web 10 contacts the roll coater 54. After that, the roll coater 54 is driven. As a result, the web 10 is coated with the coating solution by the roll coater 54.

Figure 8:
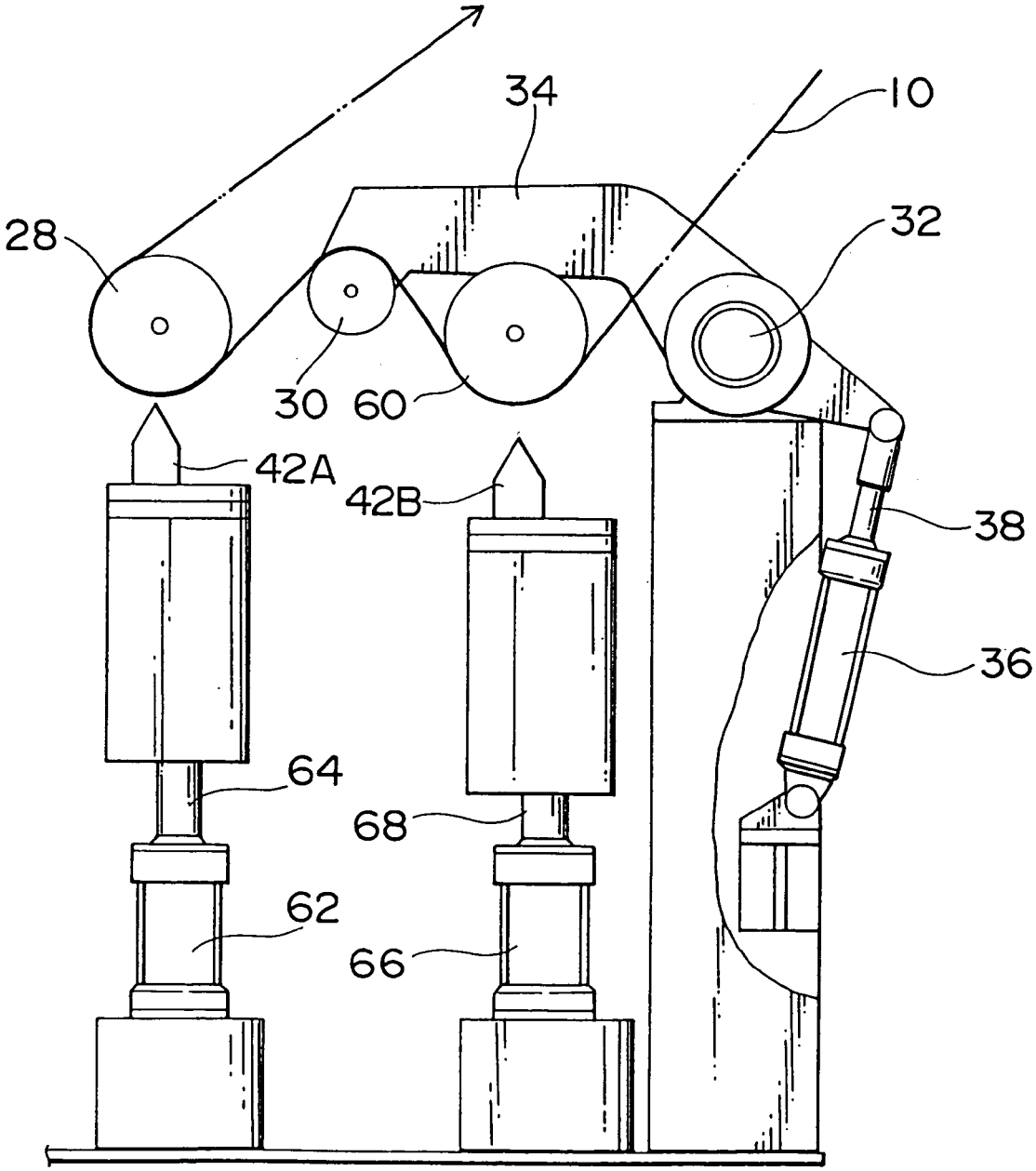
FIG. 8 is a side view showing the function of a coating apparatus according to the fourth embodiment of the invention.
Figure 9:
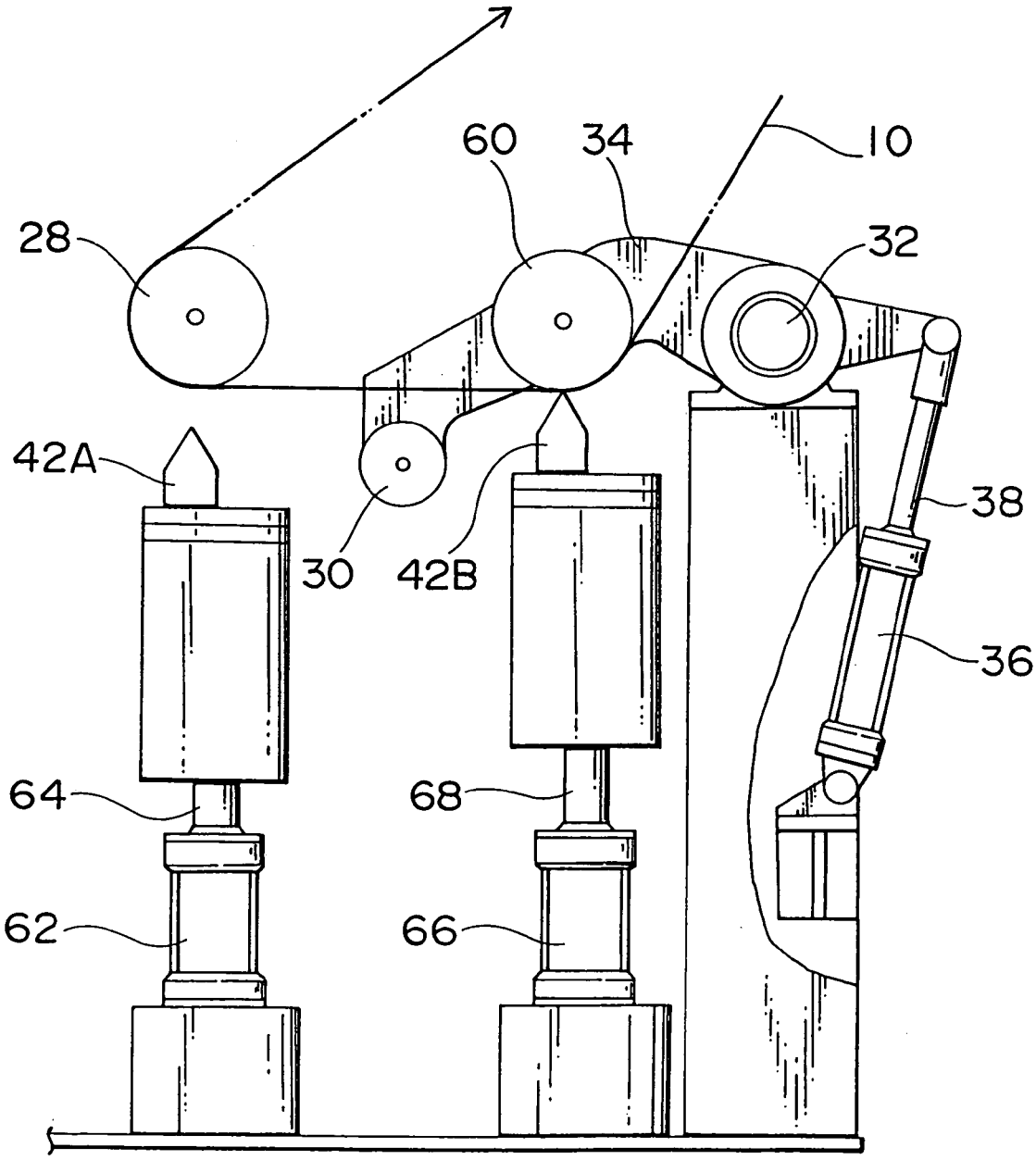
FIG. 9 is a side view showing the function of a coating apparatus according to the fourth embodiment of the invention.

FIGS. 8 and 9 show the structure of the coating apparatus according to the fourth embodiment of the invention. The same reference numbers are designated on the same or similar members as those of the first embodiment shown in FIGS. 2 and 3.

The coater in FIGS. 8 and 9 is constructed in such a manner that the pass roller 30 is arranged between two backup rollers 28 and 60, and a first extrusion coater (a coating head) 42A is arranged below the downstream backup roller 28 in such a manner as to move up and down due to the extension and contraction of a rod 64 of a hydraulic cylinder 62, and a second extrusion coater (a coating head) 42B is arranged below the upstream backup roller 60 in such a manner as to move up and down due to the extension and contraction of a rod 68 of a hydraulic cylinder 66.

When the first extrusion coater 42A is selected, as shown in FIG. 8, the pass roller 30 moves up to bend up the traveling path of the web 10 due to the contraction of the rod 38 of the hydraulic cylinder 36. The second extrusion coater 42B moves down so as to separate from the backup roller 60 due to the contraction of the rod 68 of the hydraulic cylinder 66. Then, the first extrusion coater 42A moves toward the backup roller 28 due to the extension of the rod 64 of the hydraulic cylinder 62, so that it becomes close to the web 10 supported on the backup roller 28. After that, the extrusion coater 42A is driven, and the web 10 is coated with the coating solution by the first extrusion coater 42A.

Next, if the second extrusion coater 42B is selected, as shown in FIG. 9, the pass roller 30 moves down so as to separate from the traveling path of the web 10 due to the extension of the rod 38 of the hydraulic cylinder 36. The first extrusion coater 42A moves down so as to separate from the backup roller 28 due to the contraction of the rod 64 of the hydraulic cylinder 62. Then, the second extrusion coater 42B moves up toward the backup roller 60 due to the extension of the rod 68 of the hydraulic cylinder 66, so that it becomes close to the web 10 supported on the backup roller 60. After that, the extrusion coater 42B is driven, and the web 10 is coated with the coating solution by the second extrusion coater 42B.

Figure 10:
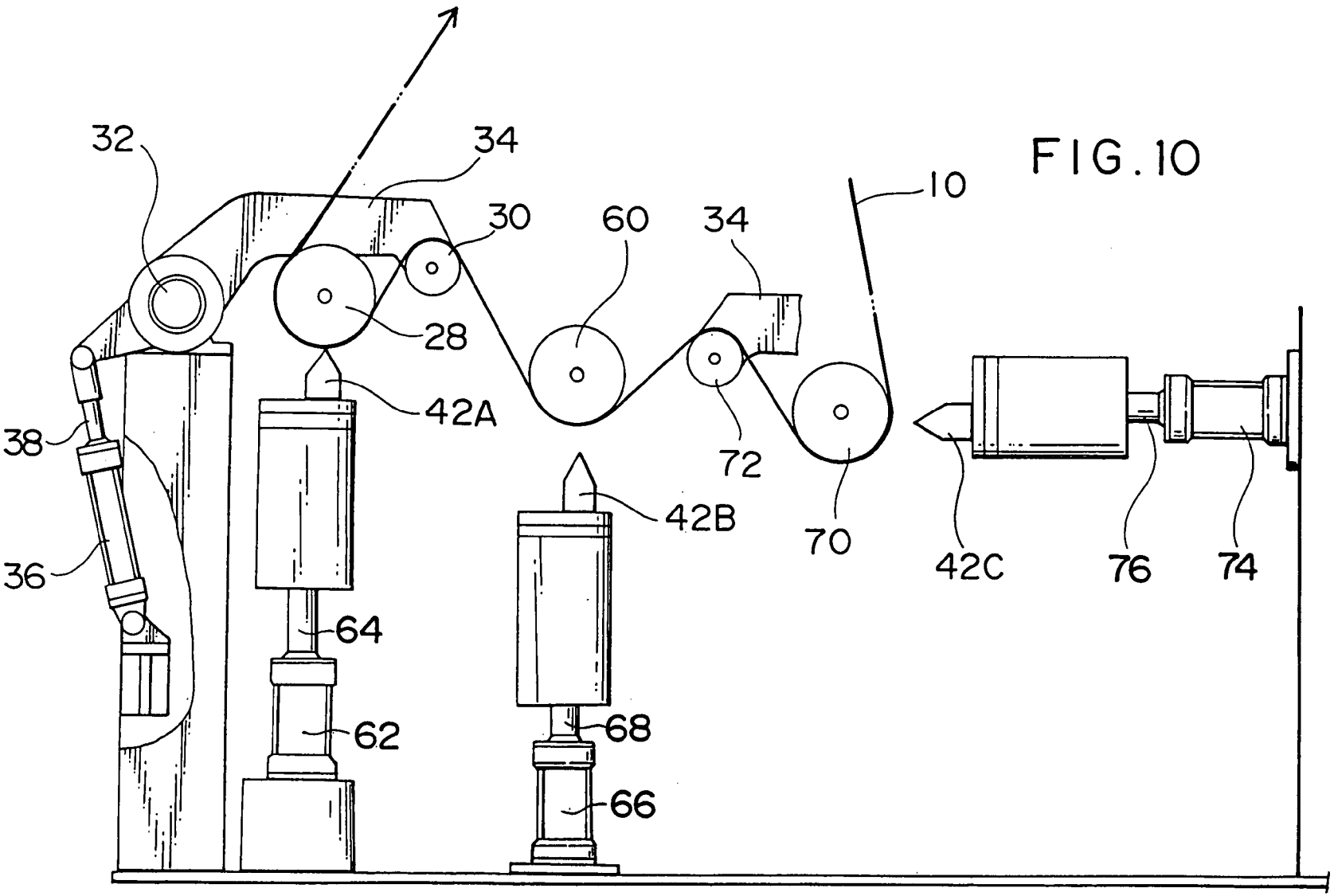
FIG. 10 is a side view showing the function of a coating apparatus according to the fifth embodiment of the invention.
Figure 11:
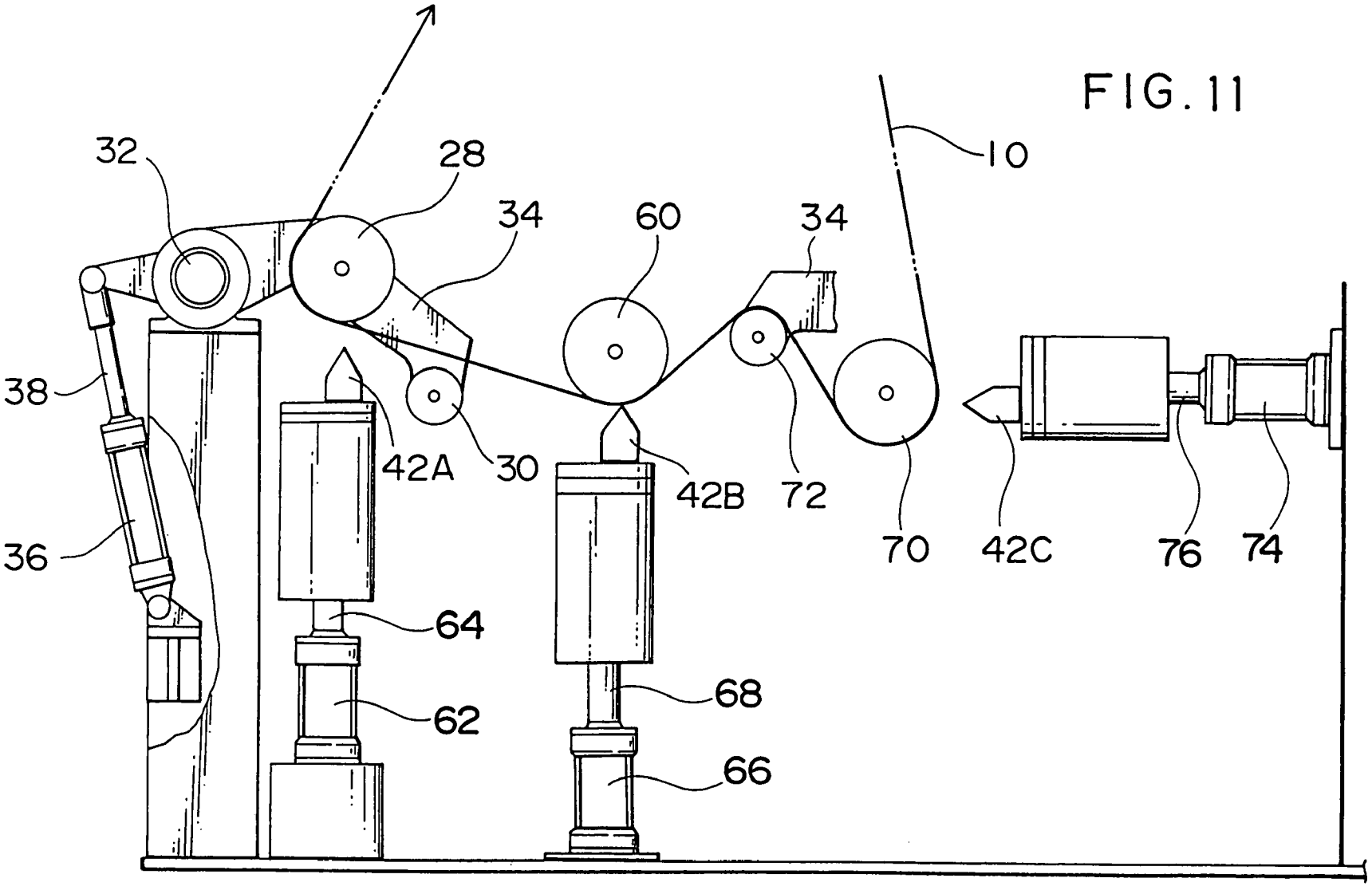
FIG. 11 is a side view showing the function of a coating apparatus according to the fifth embodiment of the invention.
Figure 12:
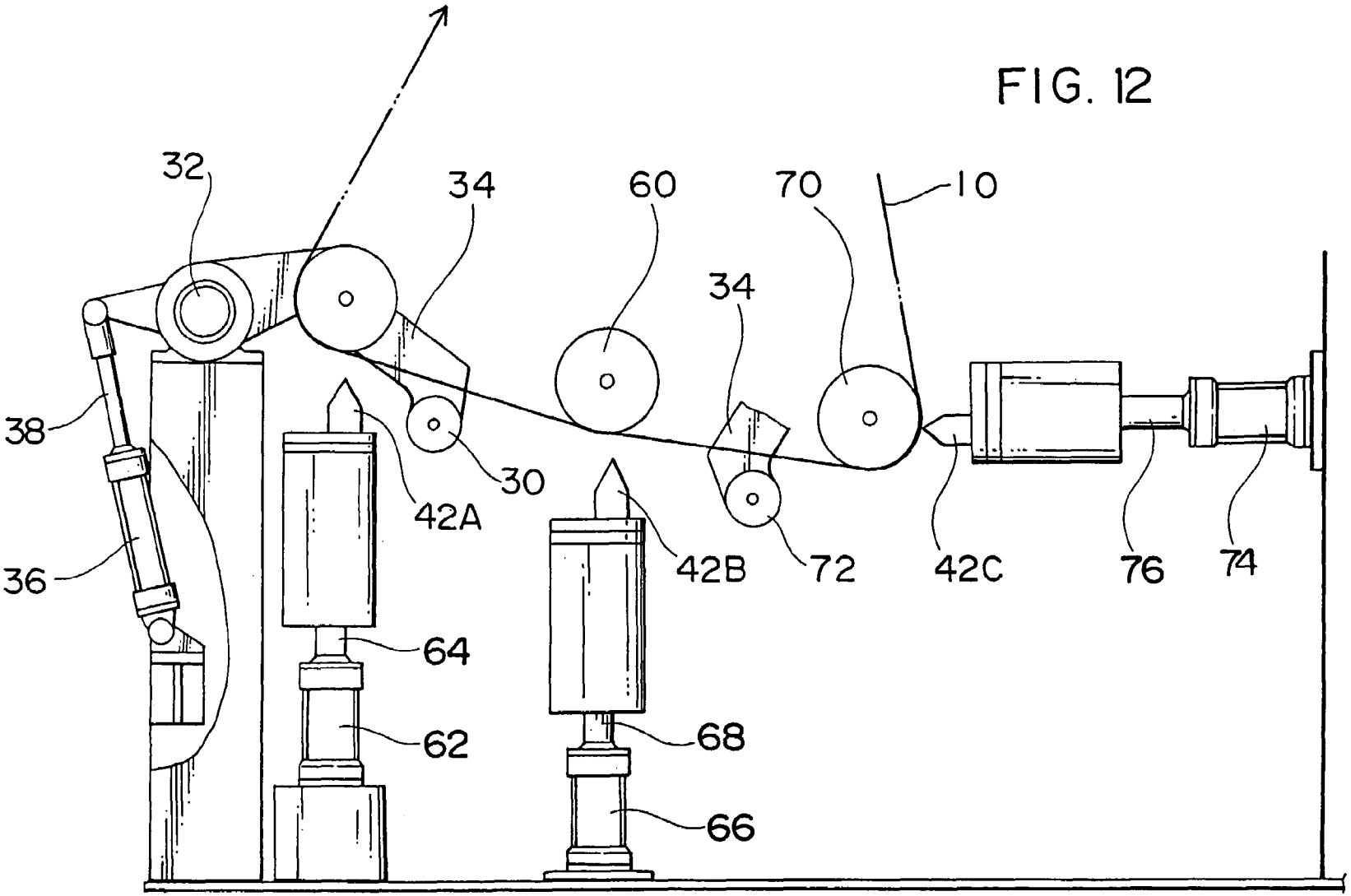
FIG. 12 is a side view showing the function of a coating apparatus according to the fifth embodiment of the invention.

FIGS. 10, 11, and 12 show the structure of the coating apparatus according to the fifth embodiment of the invention. The same reference numbers are designated on the same or similar members as those of the fourth embodiment shown in FIGS. 8 and 9.

The coater in FIGS. 10, 11 and 12 is constructed in such a manner that two pass rollers 30 and 72, which are capable of being moved up and down, are arranged between backup rollers 28 and 60, and between backup rollers 60 and 70, respectively. The first extrusion coater (the coating head) 42A is arranged below the downstream backup roller 28 in such a manner as to move up and down due to the extension and contraction of the rod 64 of the hydraulic cylinder 62. The second extrusion coater (the coating head) 42B is arranged below the central backup roller 60 in such a manner as to move up and down due to the extension and contraction of the rod 68 of the hydraulic cylinder 66. A third extrusion coater 42C (a coating head) is arranged at the right-hand side by the upstream backup roller 70 in such a manner as to move to the right and left due to the extension and contraction of a rod 76 of a hydraulic cylinder 74. Incidentally, the up and down movement mechanism of the pass roller 72 is constructed in the same manner as the up and down movement mechanism of the pass roller 30, which comprises the arm 34 and the hydraulic cylinder 36, so that a detailed explanation is omitted here.

When the first extrusion coater 42A is selected, as shown in FIG. 10, the pass rollers 30 and 72 move up to change the traveling path of the web 10 to wavy form. Then, the second extrusion coater 42B moves down so as to separate from the backup roller 60 due to the contraction of the rod 68 of the hydraulic cylinder 66. The third extrusion coater 42C moves to the right so as to separate from the backup roller 70 due to the contraction of the rod 76 of the hydraulic cylinder 74. Then, the first extrusion coater 42A moves up toward the backup roller 28 due to the extension of the rod 64 of the hydraulic cylinder 62, so that it becomes close to the web 10 supported on the backup roller 28. After that, the first extrusion coater 42A is driven, and the web 10 is coated with the coating solution by the first extrusion coater 42A.

Next, if the second extrusion coater 42B is selected, the pass roller 30 moves down so as to separate from the traveling path of the web 10 as shown in FIG. 11 from the state in FIG. 10. The first extrusion coater 42A moves down so as to separate from the backup roller 28 due to the contraction of the rod 64 of the hydraulic cylinder 62. Then, the second extrusion coater 42B moves up toward the backup roller 60 due to the extension of the rod 68 of the hydraulic cylinder 66, so that it becomes close to the web 10 supported on the backup roller 60. After that, the second extrusion coater 42B is driven, and the web 10 is coated with the coating solution by the second extrusion coater 42B.

Next, if the third extrusion coater 42C is selected, the pass roller 72 moves down so as to separate from the traveling path of the web 10 as shown in FIG. 12 from the state in FIG. 11. The second extrusion coater 42B moves down so as to separate from the backup roller 60 due to the contraction of the rod 68 of the hydraulic cylinder 66. Then, the third extrusion coater 42C moves toward the backup roller 70 due to the extension of the rod 76 of the hydraulic cylinder 74, so that it becomes close to the web 10 supported on the backup roller 70. After that, the third extrusion coater 42C is driven, and the web 10 is coated with the coating solution by the third extrusion coater 42C.

As described in the first, second, third, fourth and fifth embodiments, according to the invention, the pass roller, which is arranged close to more than two coating heads and capable of being moved up and down, is moved up and down so as to change the traveling path of the web, so that the web can become close to at least one of the plural coating heads, which is used selectively for coating. As a result, there is no need to replace the coating head every time the coating conditions are changed. Moreover, there is no need to cut the web to change the traveling path of the web. Therefore, the web can be efficiently coated with the coating solution.

Furthermore, according to the invention, the coating heads are provided in such a manner as to move toward and away from the traveling path of the web. At least one coating head selected for coating is moved toward the traveling path of the web so as to be arranged close to the web. Another coating head, which is not used, is moved away from the traveling path of the web. Therefore, in the invention, the coating by the selected coating head can be performed without fail, and the incorrect coating by another coating head can be prevented.

EXAMPLE

An explanation will hereunder be given about a practical example using the coating apparatus shown in FIG. 3. As shown in the figure, before the coating heads are changed, the pass roller 30 and the extrusion coater 42 are down, and the bar coater 40 coats the web 10. The coating solution is a solution of 12% phenol resin, and has a viscosity of 2 cp. The coating speed is 50 m/min. After the coating by the bar coater 40 is completed, the pass roller 30 and the extrusion coater 42 are moved up as shown in FIG. 2, and the extrusion coater 42 filled with a new coating solution starts the coating. The coating solution is a solution of 10% acrylic resin, and has a viscosity of 10 cp. The coating speed is 50 m/min. In this case, it takes approximately three minutes from the completion of the coating by the bar coater 40 until the start of the coating by the extrusion coater 42.

Figure 13:
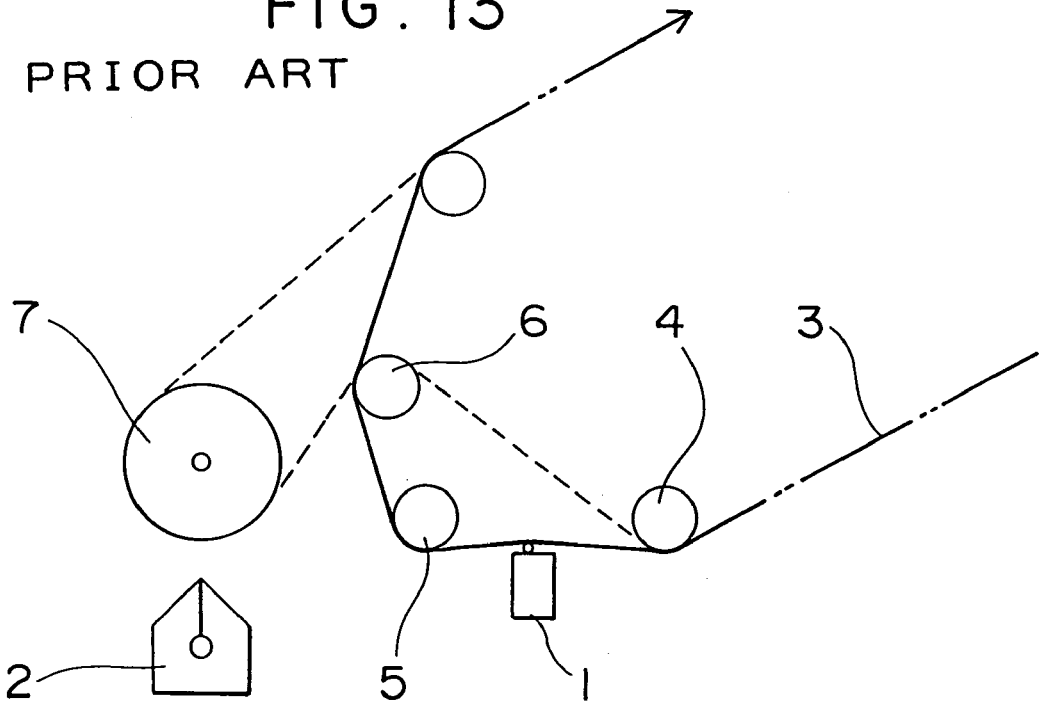
FIG. 13 PRIOR ART
FIG. 13 is a side view showing the function of the conventional coating apparatus.
Figure 14:
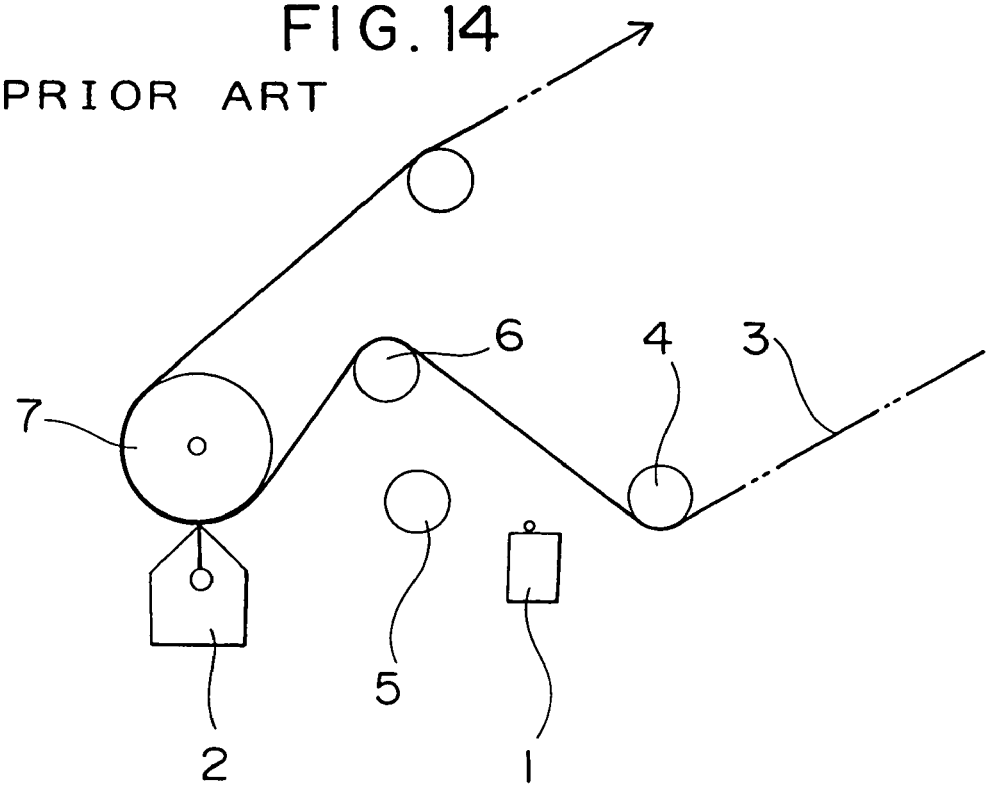
FIG. 14 PRIOR ART
FIG. 14 is a side view showing the function of the conventional coating apparatus.

The coating is changed in the conventional coater in FIGS. 13 and 14. In the state as shown in FIG. 13, a bar coater 1 performs the coating under the same conditions (the amount of the coating solution and the coating speed) as those of the above-described practical example. Then, a web 3 is cut between rollers 4 and 5, and the traveling path of the web 3 is changed to a path as shown in FIG. 14. An extrusion coater 2 is moved up, and the extrusion coater 2 starts the coating. In this case, it takes approximately 30 minutes from the completion of the coating by the bar coater 1 until the start of the coating by the extrusion coater 2.

As described above, the coating apparatus of this embodiment is able to change the coating in about 1/10 of the time required by the conventional coating apparatus.

It should be understood, however, that there is no intention to limit the invention to the specific forms disclosed, but on the contrary, the invention is to cover all modifications, alternate constructions and equivalents falling within the spirit and scope of the invention as expressed in the appended claims.

The invention claimed is:

1. A coating apparatus for a traveling web, comprising:

a plurality of coating heads used for coating a first surface of said web and arranged sequentially in a downstream traveling path of said web; and traveling path changing means for selectively changing the traveling path of said web by contacting said first surface of said web and moving said web with respect to at least one of said plurality of coating heads, wherein said coating heads are disposed on a plurality of rods, respectively, and said coating heads are moved-_toward and away from said traveling path of the web by the extension and contraction of said rods by hydraulic cylinders.

2. The coating apparatus according to claim 1, wherein said traveling path changing means comprises at least one pass roller.

3. The coating apparatus according to claim 1, wherein said plural coating heads comprise a bar coater and an extrusion coater.

4. The coating apparatus according to claim 1, wherein said plural coating heads comprise an extrusion coater and a slide bead coater.

5. The coating apparatus according to claim 1, wherein said plural coating heads comprise an extrusion coater and a roll coater.

6. The coating apparatus according to claim 1, wherein said plural coating heads comprise a first extrusion coater and a second extrusion coater.

7. The coating apparatus according to claim 1, wherein said plural coating heads comprise a first extrusion coater, a second extrusion coater, and a third extrusion coater.

* * * * *